United States Patent [19]

Meininger et al.

[11] Patent Number: 4,749,520

[45] Date of Patent: Jun. 7, 1988

[54] METHOD FOR PRODUCING CASKS CAPABLE OF ULTIMATE STORAGE WITH RADIOACTIVE WASTE, AND CASK PRODUCED IN ACCORDANCE WITH THIS METHOD

[75] Inventors: Siegfried Meininger, Altenstadt; Karl-Heinz Kleinschroth, Frankfurt am Main, both of Fed. Rep. of Germany

[73] Assignee: Kraftwerk Union Aktiengesellschaft, Mulheim an der Ruhr, Fed. Rep. of Germany

[21] Appl. No.: 852,132

[22] Filed: Apr. 15, 1986

[30] Foreign Application Priority Data

Apr. 16, 1985 [DE] Fed. Rep. of Germany ..... 3513692

[51] Int. Cl.[4] ..... G21F 9/12; G21F 9/24; G21F 5/00; G21C 19/00

[52] U.S. Cl. ..... 252/633; 250/506.1; 250/507.1; 252/628; 376/272

[58] Field of Search ..... 250/506.1, 507.1; 252/628, 633; 405/128, 129; 376/272

[56] References Cited

U.S. PATENT DOCUMENTS

| | | | |
|---|---|---|---|
| 3,731,101 | 5/1973 | Peterson et al. | 250/506.1 |
| 3,749,917 | 7/1973 | Kucherer | 250/506.1 |
| 4,187,433 | 2/1980 | Zezza | 250/506.1 |
| 4,229,316 | 10/1980 | Baatz et al. | 252/633 |
| 4,257,912 | 3/1981 | Fleischer et al. | 252/628 |
| 4,292,528 | 9/1981 | Shaffer et al. | 250/506.1 |
| 4,399,366 | 8/1983 | Bucholz | 250/507.1 |
| 4,430,256 | 2/1984 | Rustum | 252/633 |
| 4,513,205 | 4/1985 | Splinter | 250/507.1 |
| 4,535,250 | 8/1985 | Fields | 250/507.1 |
| 4,594,513 | 6/1986 | Suzuki et al. | 250/506.1 |

FOREIGN PATENT DOCUMENTS

| | | | |
|---|---|---|---|
| 3028040 | 3/1982 | Fed. Rep. of Germany | 250/507.1 |

*Primary Examiner*—Stephen J. Lechert, Jr.
*Assistant Examiner*—Howard J. Locker
*Attorney, Agent, or Firm*—Herbert L. Lerner; Laurence A. Greenberg

[57] ABSTRACT

Method for producing casks capable of ultimate storage of radioactive wastes by filling the wastes to which cement has been added into containers taking radiation shielding into consideration. The casks are filled in at least two stages with partial quantities located concentrically to each other, the volume-specific activity of which increases from stage to stage from the outside in by at least a factor of 2.

10 Claims, 3 Drawing Sheets

METHOD FOR PRODUCING CASKS CAPABLE OF ULTIMATE STORAGE WITH RADIOACTIVE WASTE, AND CASK PRODUCED IN ACCORDANCE WITH THIS METHOD

BACKGROUND OF THE INVENTION

1. Field of the Invention

The invention relates to a method for producing casks capable of ultimate storage with radioactive wastes by filling the wastes to which cement has been added, into containers, taking radiation shielding into consideration. The invention further relates to casks for use in the method.

2. Description of the Prior Art

Radiation shielding has been taken into account heretofore in wastes of different activity level by making the walls of concrete containers for receiving the wastes of different thicknesses as described in the paper "Some Techniques for the Solidification of Radioactive Wastes in Concrete" in the journal "Nuclear Technology", Vol. 32, Jan. 1977, pages 30 to 38 in particular page 36.

SUMMARY OF THE INVENTION

An object of the invention is to increase the activity content in a cask in order to accommodate more wastes or wastes with higher activity in the same volume. Wastes of interest here are particularly activity carriers accumulated in aqueous form, such as evaporator concentrate, filter sludge, ion exchanger suspensions, etc.

With the foregoing and other objects in view, there is provided in accordance with the invention a method for producing casks capable of ultimate storage of radioactive wastes by filling the wastes to which cement has been added into containers taking radiation shielding into consideration, the improvement comprising filling the casks with radioactive wastes in at least two stages with partial quantities of the radioactive wastes located concentrically to each other, the volume-specific activity of which partial quantities increases from stage to stage from the outside in by at least a factor of 2.

In accordance with the invention, there is provided a cask for ultimate storage of radioactive wastes comprising a plurality of thin-walled hollow bodies nested into each other and supported against each other by spacers which also increase the strength of the cask, filling tubes extending into the spaces between the hollow bodies and into the innermost hollow body, and a common venting tube inserted in an opening which connects with all the spaces.

Other features which are considered as characteristic for the invention are set forth in the appended claims.

Although the invention is illustrated and described herein as embodied in a method for producing casks capable of ultimate storage with radioactive waste, and cask produced in accordance with this method, it is nevertheless not intended to be limited to the details shown, since various modifications may be made therein without departing from the spirit of the invention and within the scope and range of equivalents of the claims.

BRIEF DESCRIPTION OF THE DRAWINGS

The invention, however, together with additional objects and advantages thereof will be best understood from the following description when read in connection with the accompanying drawings, in which.

DESCRIPTION OF THE PREFERRED EMBODIMENTS

Figure 1:
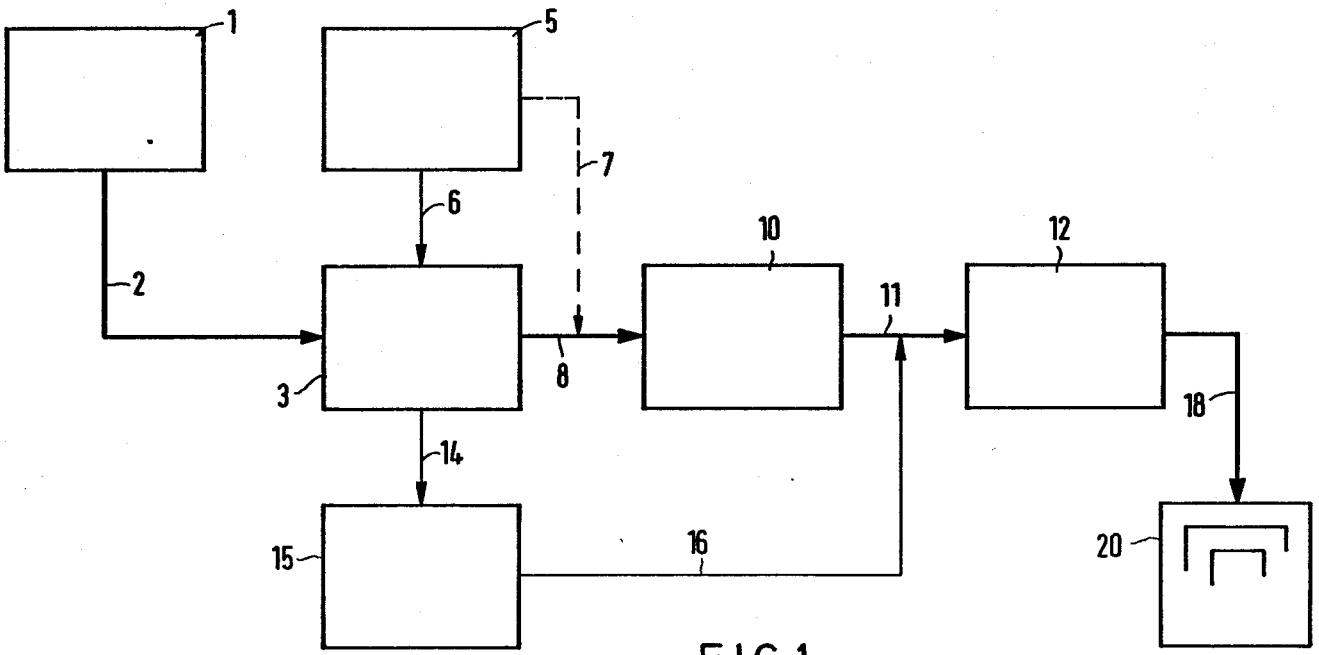
FIG. 1 schematically shows an installation for carrying out the method according to the invention.

According to the invention, the casks are filled in at least two stages with partial quantities which are disposed concentrically with each other and the specific volume activity of which increases from step to step, from the outside inward, by at least a factor of 2.

With the invention a higher activity content is made possible by a cask design which is somewhat more complex than the known design, because partial quantities with lower activity per volume form shielding for partial quantities with higher activity which are arranged further in the interior of the cask.

Radioactive wastes of a given specific radioactivity can be depleted for making the outer partial quantities, for instance, by precipitation. Radioactive wastes can also be enriched for the innermost partial quantity. Methods suitable for enrichment are known. Successive steps of a decontamination process give products of different radioactivity. Of particular advantage, a different overall radioactivity would be obtained by charging to the cask partial quantities with different radioactivities.

The partial quantities are preferably formed into the shape of a cube because it approximates the ideal shape of a sphere most closely, although other cask shapes may be employed. In the case of a cube, the cask consists of an inner cube with the smallest side length and highest specific activity, which is surrounded by several, but at least one body which is cube-shaped externally. The wall thickness created by the inclusion of the body must correspond at least to the required shielding thickness and be, for instance, equal to one-half the side length of the innermost cube. However, spherical partial quantities may be arranged concentrically. Furthermore, cylindrical shapes can also be used economically where the end faces of the cylinders are provided with plane walls of a thickness equal to the wall thickness of the cylinders nested within each other.

The outside of the partial quantities can advantageously be bounded, independently of their shape, by thin-walled hollow bodies which are nested within each other and are supported against each other by spacers designed as armor. Such hollow bodies can consist of plastic or of sheet metal. The inner hollow bodies can be connected via tubes to the outside of the outermost hollow body, thus creating filling canals. If venting is required, this can be achieved advantageously by a tube which leads into the innermost hollow body and has connecting openings into the region of the other hollow bodies.

To explain the invention in greater detail, an embodiment example will be described, referring to the drawings.

The installation shown in FIG. 1 comprises a first container 1, in which evaporator concentrate is collected. The evaporator concentrate can be pretreated there, for instance, by chemical treatment such as precipitation and/or by forming flakes. It is then transported via line 2 to a decanter 3.

A further container 5 contains filter concentrate. This involves filter sludge. The filter concentrates can likewise be put in the decanter 3 via line 6. The filter concentrates from container 5 may be fed through line 7, shown dashed, into a liquid line 8 which leads from the decanter 3 to a thickener 10.

The thickener 10 is substantially an evaporator vessel in which by feeding or replenishing decontaminated raw solution, a liquid volume as small as possible is produced for later cementing. The thickener 10 is connected via a line 11 to a cementing facility 12.

The discharge of solids from the decanter which contains the substances enriched with higher radioactivity is transported via a gravity line 14 into a sludge container 15. The moisture content of the sludge can be, for instance, about 50 percent. The solid matter is conducted from the sludge container 15 through line 16 into line 11 leading to the cementing facility 12.

The cementing facility 12 operates preferably with continuous flow. With a worm mixer it causes intimate mixing of the liquid-containing radioactive wastes with cement which is fed from a silo and to which additives, setting accelerators or inhibitors can be added as required. However, the latter can also be added to the concentrate in liquid form. The discharge 18 of the cementing facility 12 which may be equipped with a pump for thickened material leads into the casks 20 in accordance with the invention.

Figure 2:
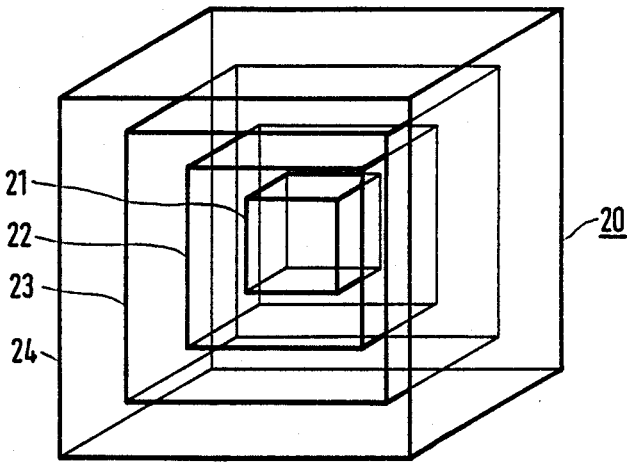
FIG. 2 shows a simplified perspective view of a cask according to the invention.

The casks 20 can consist, for instance, as is shown in FIG. 2, of four concentrically arranged cubes 21, 22, 23 and 24. The side length of the cubes depends on their activity inventory. In this embodiment example, the side length of the outermost cube 24 is 2 m, that of the innermost cube 21 is 50 cm. The cubes 22 and 23 have side lengths of 1 m and 1.50 m. The cubes 22, 23 and 24 have the same wall thicknesses of 25 cm each in this example.

Figure 3:
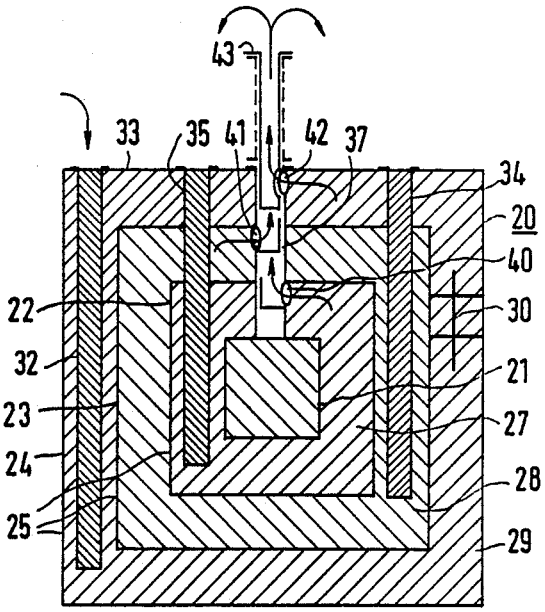
FIGS. 3 and 4 are two orthogonal views of the casks with further details.
Figure 4:
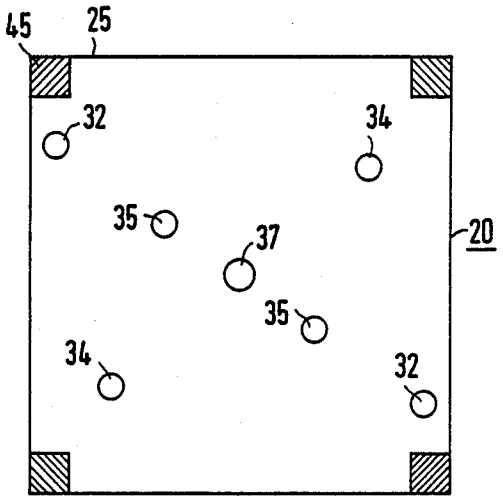

As is shown in FIGS. 3 and 4, the cubes are constructed by means of thin-walled metal sheets 25 which form the outer boundaries of the cubes 21 to 24. The spaces 27, 28 and 29 are equipped with armor 30 which is only indicated and is required for a self-supporting design. The armor can, at the same time, form the spacers between the metal sheets 25.

Two tubes 32, starting from the surface 33 of the sheet metal envelope 24, each leads through the metal sheets 25 located on the top side into the space 29. Two further tubes 34 lead from the surface 33 into the space 28, and again two further tubes 35 lead into the space 27. These tubes serve as immersion tubes for the rising filling of the individual tubes without air inclusions. A common tube 37 for venting is provided for all partial quantities which extends from the top side of the cube 21 vertically upward and is connected to the hollow spaces 27, 28 and 29 to vent openings 40, 41 and 42. A pipe stub 43 is placed on the tube 37 and serves as a rising gate for the innermost chamber with the wall 21. Similar rising gates can also be placed on the tubes 32, 34 and 35.

FIG. 4 shows that the filling tubes 32, 34, 35 and 37 are distributed uniformly over the top side 33 of the cask 20. It is also seen therefrom that the corners 45 of the cask are reinforced with so-called "iso-corners" to enable commercially available handling tools to be used for lifting the cask 20.

The cask 20 is filled with waste of different activity and stirred with cement. For the outer layer of the cask 20, i.e. for the space 29, the weakly active salt-loaded clear overflow material from the thickener 10 which is further thickened for reducing the volume is used. In this example, it forms a specific volume of 4.6 $m^3$ with a specific activity of about 2 $mCi/m^3$.

The space 28 is filled primarily with filter concentrate from the container 5. Its specific activity is, for example, about 0.1 $Ci/m^3$. The specific volume of 2.4 $m^3$ thereby contains 0.25 Ci.

The precipitation sludge of the decanter 3 from the sludge container 15 is fed into the third chamber 27. Additionally, the reactor water purification resins can be added, if desired, via the line 7. Here, the permissible specific activity is, for instance, about 10 $Ci/m^3$. The volume of the chamber 27 is 0.875 $m^3$, so that an activity inventory of about 10 Ci can be accommodated.

While the innermost cube 21 has only a specific volume of 0.125 $m^3$, it can be filled with specific activity of about 500 $Ci/m^3$, so that about 50 Ci are taken up in this small space. The total activity of the cask 20 is therefore about 70 Ci without exceeding on the outside the permissible dose rate of, for instance, 200 mrem/h and 10 mrem/h at a distance of two meters from the cask 20. As compared to the dose rate the activity contents furthermore are nuclide-dependent. The total weight of the cask 20 is about 20 tons which is at the same time a co-determining factor for the dimensional limits.

The foregoing is a description corresponding, in substance, to German application No. P 35 13 692.8, dated Apr. 16, 1985, international priority of which is being claimed for the instant application and which is hereby made part of this application. Any material discrepancies between the foregoing specification and the specification of the aforementioned corresponding German application are to be resolved in favor of the latter.

This is claimed:

1. In a method for producing casks capable of ultimate storage of radio-active wastes by filling the wastes to which cement has been added into containers to increase the activity content in a cask in order to accommodate more wastes or wastes with higher activity in the same volume, the improvement comprising, filling the casks with radioactive wastes in at least two stages with partial quantities of the radioactive wastes extending from a partial quantity of waste at the center of the cask and a partial quantity of waste adjacent to the surface of the cask, with each partial quantity of waste for each stage from the outside in having a different and higher specific activity disposing each succeeding partial quantity from stage to stage around each preceding partial quantity, with the volume-specific activity of partial quantities increasing from stage to stage from the outside in by at least a factor of 2, the partial quantity with lower volume-specific activity forming a shielding for the partial quantity with higher activity which is disposed further in the interior of the cask.

2. Method according to claim 1, wherein the radioactive wastes are depleted for the outer partial quantities but are enriched for the innermost partial quantities.

3. Method according to claim 1, wherein the partial quantities loaded into the casks are products with different radioactivity from successive steps of a decontamination process.

4. Method according to claim 1, wherein each partial quantity has its outer surfaces formed into a shape of a cube.

5. Method according to claim 2, wherein each partial quantity has its outer surface formed into a shape of a cube.

6. Method according to claim 3, wherein each partial quantity has its outer surfaces formed into a shape of a cube.

7. Method according to claim 1, wherein the outside of the partial quantity is bounded by thin-walled hollow bodies having a generally externally cubic or cylindrical shape, which bodies are nested into each other and supported against each other by spacers, which spacers also act to increase the strength of the cask.

8. Method according to claim 2, wherein the outside of the partial quantity is bounded by thin-walled hollow bodies having a generally externally cubic or cylindrical shape, which bodies are nested into each other and supported against each other by spacers, which spacers also act to increase the strength of the cask.

9. Method according to claim 7, wherein the hollow bodies are connected to the outside of the outermost hollow body via tubes that can be closed.

10. Method according to claim 9, wherein the hollow bodies are vented via the tube of the innermost hollow body.

* * * * *